US007969083B2

(12) United States Patent
Chang et al.

(10) Patent No.: US 7,969,083 B2
(45) Date of Patent: Jun. 28, 2011

(54) DISCHARGE LAMP AND PRODUCTION METHOD THEREOF

(75) Inventors: Tjong-Ren Chang, Hsin-Chu (TW); Jin-Yuh Lu, Taipei (TW); Wen-Chun Chiu, Yilan (TW); Wei-Yuan Tsou, Daxi Town (TW)

(73) Assignee: Wellypower Optronics Corporation, Hsin-Chu (TW)

( * ) Notice: Subject to any disclaimer, the term of this patent is extended or adjusted under 35 U.S.C. 154(b) by 244 days.

(21) Appl. No.: 12/348,732

(22) Filed: Jan. 5, 2009

(65) Prior Publication Data

US 2010/0052508 A1 Mar. 4, 2010

(30) Foreign Application Priority Data

Aug. 27, 2008 (TW) ..... 97132723 A

(51) Int. Cl.
*H01J 1/62* (2006.01)

(52) U.S. Cl. ..... 313/486; 313/484; 445/26

(58) Field of Classification Search ..... 313/623, 313/627–643, 567, 111–117, 25–27, 318.01–318.09, 313/483–493; 439/615, 739; 445/24, 26, 445/29, 22
See application file for complete search history.

(56) References Cited

U.S. PATENT DOCUMENTS

| | | | | |
|---|---|---|---|---|
| 5,592,052 | A * | 1/1997 | Maya et al. | 315/291 |
| 5,866,984 | A * | 2/1999 | Doughty et al. | 313/643 |
| 6,034,471 | A * | 3/2000 | Jennato et al. | 313/485 |
| 2004/0171327 | A1 * | 9/2004 | Kobayashi et al. | 445/26 |
| 2006/0261723 | A1 * | 11/2006 | Terada et al. | 313/485 |
| 2007/0264898 | A1 * | 11/2007 | IImura | 445/23 |
| 2008/0252193 | A1 * | 10/2008 | Yamada et al. | 313/486 |

* cited by examiner

*Primary Examiner* — Nimeshkumar D Patel
*Assistant Examiner* — Donald L Raleigh
(74) *Attorney, Agent, or Firm* — Snell & Wilmer L.L.P.

(57) ABSTRACT

A discharge lamp is disclosed, including a sealed vessel with an inner surface, at least one illuminating gas filled inside the sealed vessel, and a fluorescent layer coated on the inner surface. The composition of the fluorescent layer is adjusted according to a colored light emitted by the illuminating gas during a discharge process within the sealed vessel, such that the colored light is converted into a visible light after passing through the fluorescent layer.

23 Claims, 5 Drawing Sheets

500

600

DISCHARGE LAMP AND PRODUCTION METHOD THEREOF

CROSS REFERENCE TO RELATED APPLICATIONS

This application claims the right of priority based on Taiwan Patent Application No. 097132723 entitled "DISCHARGE LAMP AND PRODUCTION METHOD THEREOF," filed on Aug. 27, 2008, which is incorporated herein by reference and assigned to the assignee herein.

FIELD OF INVENTION

The invention relates to a discharge lamp, and more particularly, to a fluorescent discharge lamp.

BACKGROUND OF THE INVENTION

FIG. 1 shows a structure of a known discharge lamp, including a sealed vessel (such as a glass tube) 10, a fluorescent layer 11, noble gas 20 (such as argon or neon), mercury atoms 21 and a pair of electrodes 30. The electrodes 30 are disposed on two ends of the sealed vessel 10 and connected to a power source (not shown). When voltage applied between the two electrodes initiates a discharge process, electrons generated during the discharge process collide with mercury atoms 21 such that the mercury atoms 21 are excited to an excited state. Afterwards, ultraviolet light is emitted as the mercury atoms 21 move from the excited state back to the unexcited state. The ultraviolet light is then converted into visible light after passing through the fluorescent layer 11.

The fluorescent layer 11 is formed by mixing red fluorescent powder, green fluorescent powder, and blue fluorescent powder, and the percent ratio of three fluorescent powders can be adjusted to obtain the desired color temperature and chromaticity. However, each of the three fluorescent powders can affect the property of the fluorescent layer 11, which makes the process more complex and therefore increases the manufacturing cost. In addition, mercury may lead to significant environmental contamination.

Therefore, it is necessary to provide a discharge lamp which can reduce the production cost of the fluorescent powder, simplify the process of producing the mixed fluorescent powder, and comply with environmental protection trends.

SUMMARY OF THE INVENTION

In one embodiment, the present invention discloses a discharge lamp, including a sealed vessel having an inner surface, at least an illuminating gas filled within the sealed vessel; and a fluorescent layer coated on the inner surface. The composition of the fluorescent layer is determined according to a colored light emitted by the illuminating gas during a discharge process within the sealed vessel, such that the colored light is converted into a visible light after passing through the fluorescent layer.

In another embodiment, the present invention discloses a method of manufacturing a discharge lamp, including: coating a fluorescent layer on an inner surface of a sealed vessel; filling the sealed vessel with at least one illuminating gas; and adjusting composition of the fluorescent layer according to a colored light emitted by the illuminating gas during a discharge process within the sealed vessel, such that the colored light is converted into a visible light after passing through the fluorescent layer.

According to the present invention, the composition or the thickness of the fluorescent layer and the concentration of the illuminating gas can be adjusted based on the colored light emitted by the illuminating gas, whereby a discharge lamp with no mercury can be manufactured. The discharge lamp of the present invention may include but not limited to: cold cathode fluorescent lamp (CCFL), flat fluorescent lamp (FFL), hot cathode fluorescent lamp (HCFL), and external electrode fluorescent lamp (EEFL).

The foregoing and other features of the invention will be apparent from the following more particular description of embodiment of the invention.

BRIEF DESCRIPTION OF THE PICTURES

The present invention is illustrated by way of example and not intended to be limited by the accompanying drawing, in which like notations indicate similar elements.

DETAILED DESCRIPTION OF THE INVENTION

Figure 1:
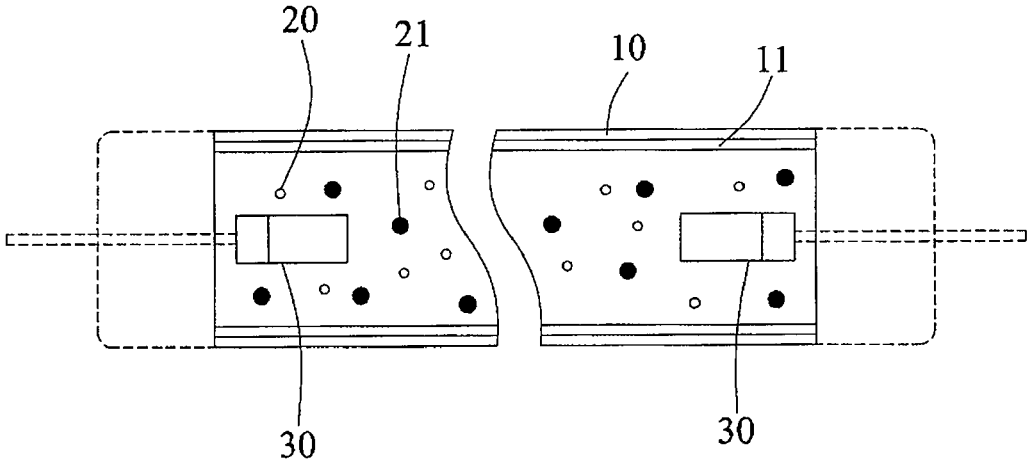
FIG.1 PRIOR ART
FIG. 1 shows a structure of a known discharge lamp.
Figure 2:
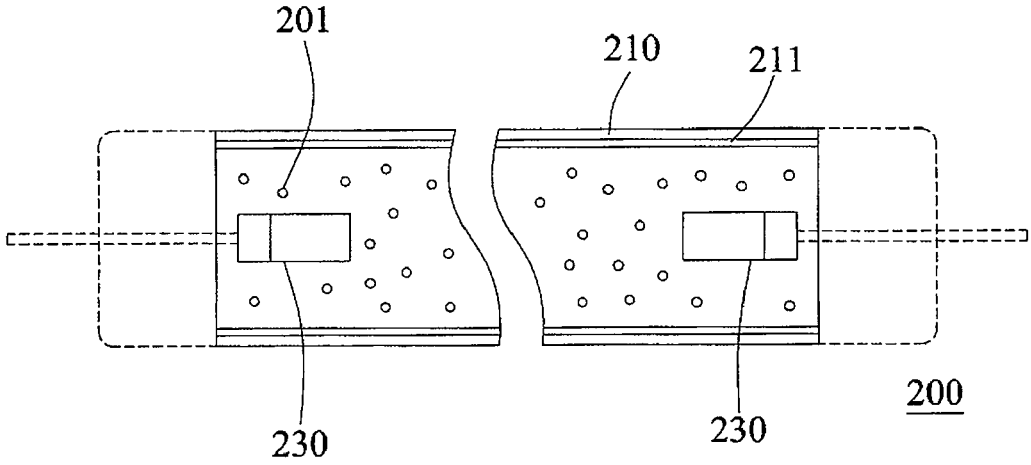
FIG. 2 shows an illustrative diagram of a discharge lamp according to one embodiment of the present invention.

A discharge lamp without mercury and capable of reducing manufacturing cost is disclosed in the present invention. FIG. 2 shows an illustrative diagram of a discharge lamp 200 according to one embodiment of the present invention, which includes a sealed vessel (such as a glass tube) 210, a fluorescent layer 211, red illuminating gas 201 (such as neon), and a pair of electrodes 230. The electrodes 230 are located at two ends of the sealed vessel 210 and connected to a power source (not shown). When voltage applied between the two electrodes initiates a discharge process within the sealed vessel 210, electrons (not shown) which are emitted from one of the electrodes 230 (cathode) collide with the red illuminating gas 201 such that the red illuminating gas 201 is excited to an excited state. Afterwards, red light (at 74 nm wavelength) is emitted when atoms of the red illuminating gas 201 move from the excited state back to the unexcited state. By adjusting the composition of the fluorescent layer 211, the red light can be converted into visible light after passing through the fluorescent layer 211. In this embodiment, the fluorescent layer 211 includes green fluorescent powder and blue fluorescent powder. The desired color temperature and chromaticity of the visible light emitted during the discharge process within the discharge lamp 200 can be obtained by adjusting the percent ratio of the green fluorescent powder and the blue fluorescent powder or changing the concentration of the red illuminating gas 201 (such as neon) within the sealed vessel 210. In one embodiment, the blue fluorescent powder can be (Sr,Ca,Ba,Mg)10$(PO_4)_6C_{12}$:Eu, (Ba,Sr,Eu)(Mg,Mn)$Al_{10}O_{17}$, Sr10(PO4)6C12:Eu, (Ba,Eu)$MgAl_{10}O_{17}$, $BaMg_2Al_{16}O_{27}$:Eu, $BaMgAl_{10}O_{17}$:Eu, or the combination thereof, and the green fluorescent powder can be $LaPO_4$:Ce, Tb, (Ce,Tb)(Mg)$A_{11}O_{19}$, (Ba,Eu)(Mg,Mn)$Al_{10}O_{17}$, $MgAl_{11}O_{19}$:(Ce,Tb), or the combination thereof.

Differing from a conventional discharge lamp, which needs to use a three-color fluorescent powder mixed by red fluorescent powder, green fluorescent powder, and blue fluorescent powder, the discharge lamp of the present invention can use a two-color fluorescent powder by filling at least one illuminating gas within the discharge lamp. For example, the fluorescent layer can include only green fluorescent powder and blue fluorescent powder when the filled gas is red illuminating gas whereby the manufacture process of the fluorescent layer can be simplified and the cost can be reduced.

Further, in this embodiment, the red light is emitted when atoms of the red illuminating gas 201 move from the excited state back to the unexcited state during the discharge process, and then the red light is converted into the visible light with desired color temperature and chromaticity after passing through the fluorescent layer 211 composed of the green fluorescent powder and the blue fluorescent powder. Therefore, ultraviolet light emitted from the mercury atom is no longer required, i.e. the sealed vessel 210 can have no mercury atom therewithin, and a mercury-free fluorescent lamp can then be produced.

Except for the red illuminating gas (such as neon), other illuminating gases (such as krypton or xenon) which can emit light with other color can be adopted, and correspondingly, the composition of the fluorescent layer has to be adjusted. Typically, the appropriate wavelength of the colored light emitted by the illuminating gas is about 50 nm to 400 nm.

Taking the krypton gas for example, because it emits the green light (at 146 nm wavelength) during the discharge process, the corresponding fluorescent layer generally would comprise the red fluorescent powder (such as $Y_2O_3$:$Eu^{3+}$) and blue fluorescent powder (such as $BaMg_2Al_{16}O_{27}$:Eu), whereby the green light can be converted into the visible light with desired color temperature and chromaticity after passing through the corresponding fluorescent layer.

Taking the xenon gas for example, because it emits the blue light (at 172 nm wavelength) during the discharge process, the corresponding fluorescent layer generally would comprise the green fluorescent powder (such as $MgAl_{11}O_{19}$:Ce, Tb) and red fluorescent powder (such as $Y_2O_3$:$Eu^{3+}$), whereby the blue light emitted from the xenon gas can be converted into the visible light with desired color temperature and chromaticity after passing through the corresponding fluorescent layer.

Figure 3:
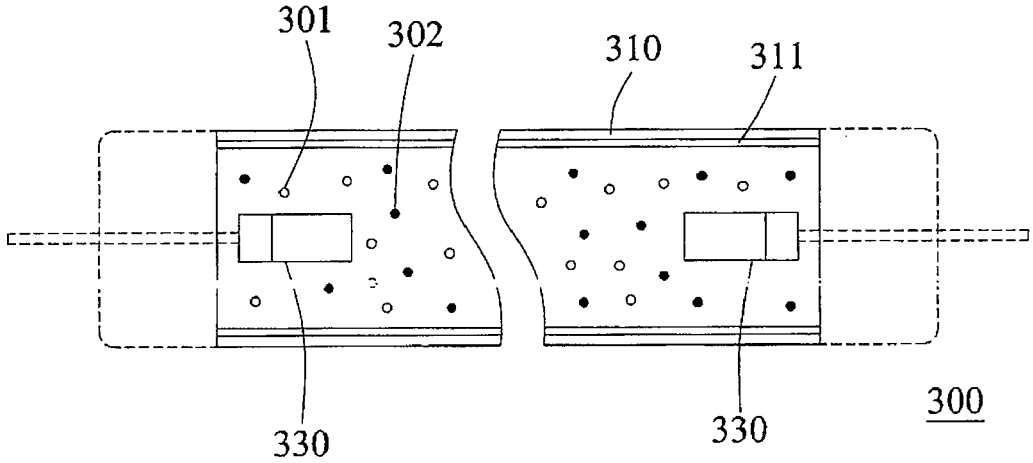
FIG. 3 shows an illustrative diagram of a discharge lamp according to another embodiment of the present invention.

The vessel of the discharge lamp can not only be filled with one kind of illuminating gas, but with two different kinds of illuminating gases. Referring to FIG. 3, a discharge lamp 300 according to another embodiment of the present invention is shown, which includes a sealed vessel (such as a glass tube) 310, a fluorescent layer 311, green illuminating gas 301, blue illuminating gas 302 and a pair of electrodes 330. The electrodes 330 are located at two ends of the sealed vessel 310 and connected to a power source (not shown). When voltage applied between the two electrodes initiates a discharge process within the sealed vessel 310, a colored light formed by mixing green light and blue light together is emitted by the green illuminating gas 301 and the blue illuminating gas 302. By adjusting the composition of the fluorescent layer 311, the mixed colored light can be converted into visible light after passing through the fluorescent layer 311. In this embodiment, the green illuminating gas 301 can be any gas capable of emitting green light, such as krypton, and the blue illuminating gas 302 can be any gas capable of emitting blue light, such as xenon.

In the embodiment shown in FIG. 3, the fluorescent layer 311 can only include red fluorescent powder. The desired color temperature and chromaticity of the visible light emitted during the discharge process within the discharge lamp 300 can be obtained by adjusting the thickness of the red fluorescent powder or changing the concentration of the green illuminating gas 301 and the blue illuminating gas 302 within the sealed vessel 310.

Figure 4:
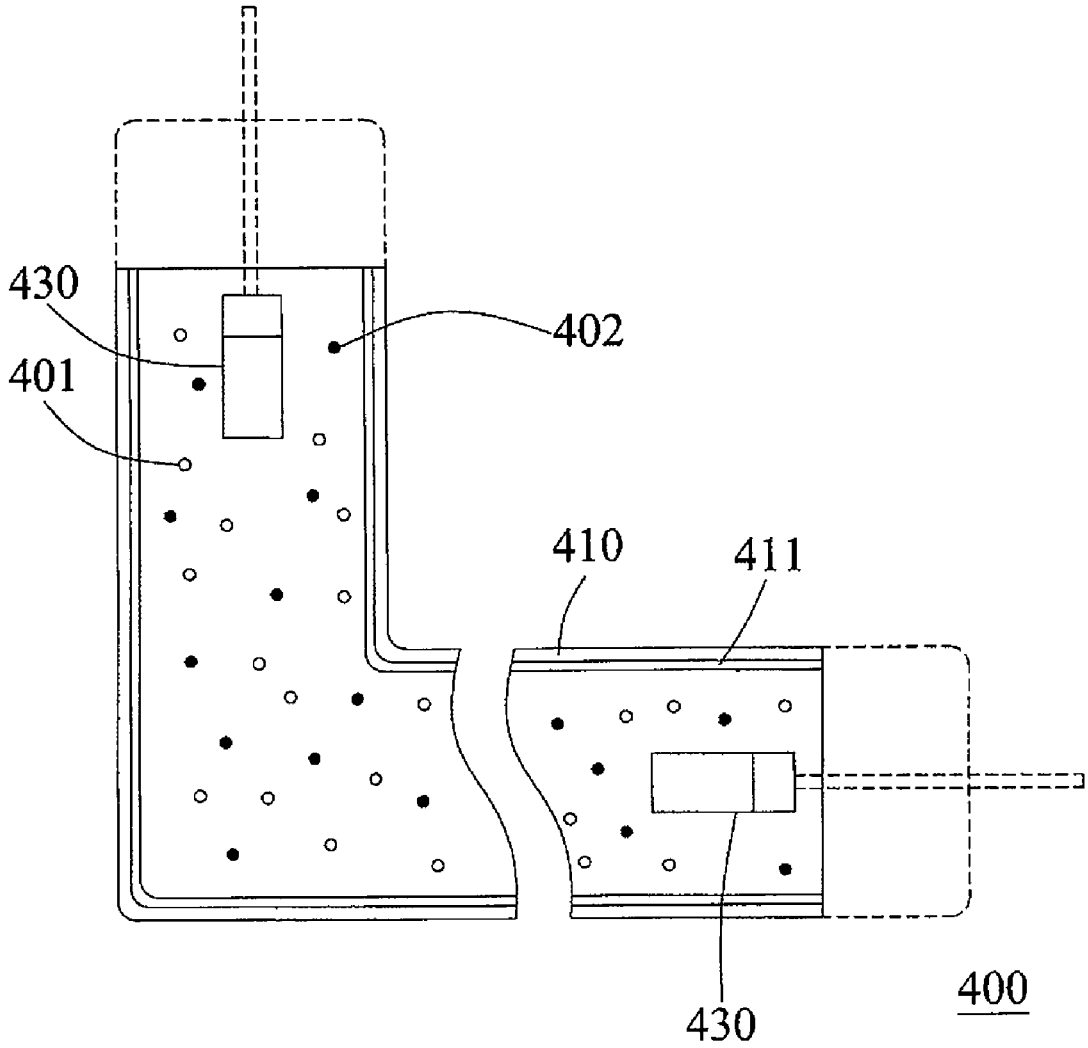
FIG. 4 shows an illustrative diagram of a discharge lamp according to another embodiment of the present invention.

FIG. 4 shows an illustrative diagram of a discharge lamp 400 according to one embodiment of the present invention, which includes a sealed vessel (such as a glass tube) 410, a fluorescent layer 411, green illuminating gas 401, blue illuminating gas 402, and a pair of electrodes 430. Comparing FIG. 4 with FIG. 3, the sealed vessel 310 in FIG. 3 is straight in shape, but the sealed vessel 410 is formed as having a L shape. It should be noted that the sealed vessel may include various geometric shapes, such as straight shape or curved shape with at least one curved portion like U-shaped portion, L-shaped portion, or spiral-shaped portion.

Figure 5:
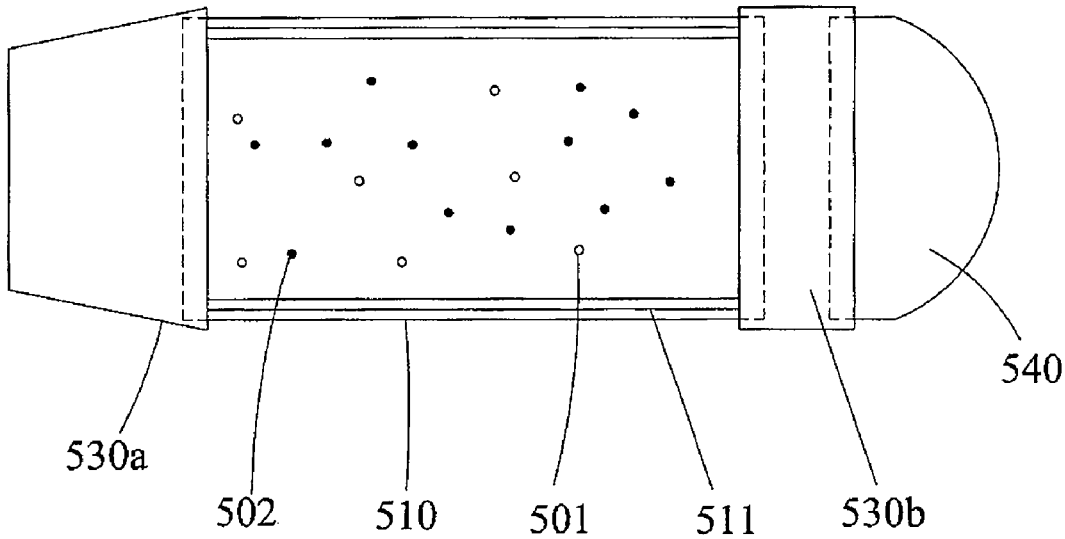
FIG. 5 shows an illustrative diagram of a discharge lamp according to another embodiment of the present invention.

FIG. 5 shows a discharge lamp 500 produced according to one embodiment of the present invention, which includes a glass tube 510 having an inner surface coated with a fluorescent layer 511, green illuminating gas 501, blue illuminating gas 502, a pair of electrodes 530*a* and 530*b*, and a glass tube 540. Comparing FIG. 5 with FIG. 3, the electrodes 330 in FIG. 3 are located inside the sealed vessel 310, but the electrodes 530*a* and 530*b* are located outside two ends of the glass tube 510. In this embodiment, the electrode 530*a* is cup-shaped with an opening on one end thereof, and the electrode 530*b* is hollow-shaped with openings at two ends. The shape of the electrodes 530*a* and 530*b* can be, for example, circular shape, cylinder shape, or cone shape. The electrode 530*b* can be joined with the glass tubes 510 and 540 by an adhesive or by thermal bonding. However, in this embodiment, the electrode 530*a* is not connected to the glass tube 510 in the manner that its counterpart electrode 530*b* is connected to the glass tube 510, but is directly connected thereto by sealing. The cup-shaped electrode 530*a* has only one opening, and therefore the glass tube 510 can be sealed at one end by directly connecting with the electrode 530*a*, without adding another glass tube (such as glass tube 540). It can be appreciated that the adoption of the electrode 530*a* can not only reduce the production cost but also shorten the whole length of the discharge lamp 500.

Figure 6:
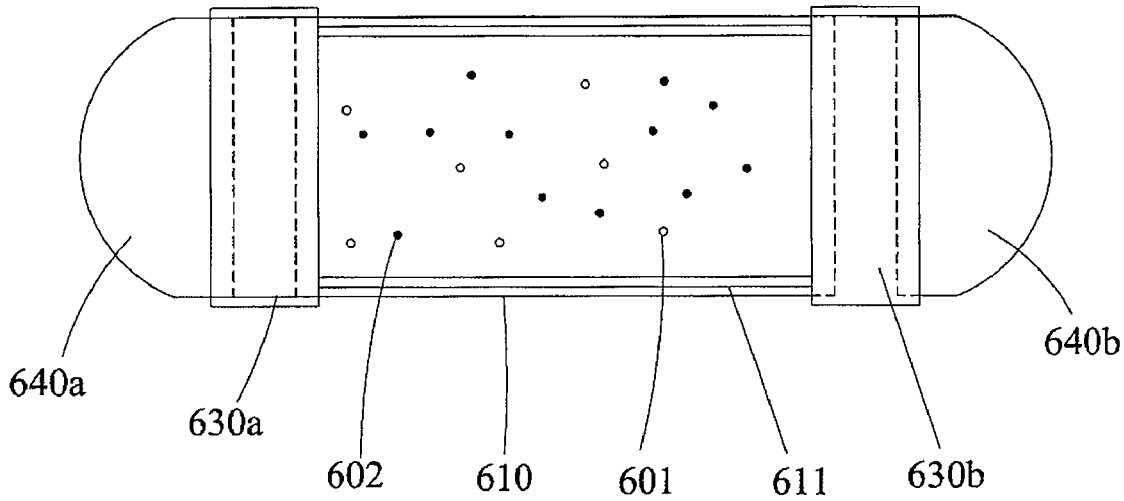
FIG. 6 shows an illustrative diagram of a discharge lamp according to another embodiment of the present invention.

FIG. 6 shows an illustrative diagram of a discharge lamp 600 according to another embodiment of the present invention, which includes a glass tube 610 having an inner surface coated with a fluorescent layer 611, green illuminating gas 601, blue illuminating gas 602, a pair of hollow circular electrodes 630*a* and 630*b*, and two glass tubes 640*a* and 640*b*. Comparing FIG. 6 with FIG. 3, the electrodes 330 in FIG. 3 are located inside the sealed vessel 310, but the electrodes 630*a* and 630*b* are located outside two ends of the glass tube 610. A conductive metal layer, such as gold, silver, copper, or tin, can be formed on the outside surface of the electrodes 630*a* and 630*b*, such that the capacitor effect can be induced when applying voltage between two electrodes 630*a* and 630*b*, which in turn causes the gas discharge phenomena within the glass tube 610. The geometric shape of the electrodes 630*a* and 630*b* can be, for example, hollow circular shape, cylinder shape, or cone shape with openings at two ends. It should be noted that the material of the electrodes 630*a* and 630*b* may differ from that of the electrodes 330 located inside the sealed vessel 310 in FIG. 3. For example, the electrodes 630*a* and 630*b* can be metal, paraelectric oxide ceramics, ferroelectric oxide ceramics, anti-ferroelectric oxide ceramics, oxide ceramics with an outer surface coated with conductive metal (such as gold, silver, copper, or tin), or the combination thereof. In one preferred embodiment, the electrodes 630*a* and 630*b* can be the oxide ceramic including $BaTiO_3$, $SrTiO_3$, $PbTiO_3$, $PbZrO_3$, CaO, $TiO_2$, SrO, $ZrO_2$, MgO, or the combination thereof. In one embodiment, the electrode 630*a* and 630*b* can be joined with the glass tubes 610, 640*a* and 640*b* by an adhesive. In another embodiment, the electrodes 630*a* and 630*b* further comprise one or more selected from a group consisting of MnO, $Al_2O_3$, $Fe_2O_3$ and $Cr_2O_3$. In other embodiments, glass frits such as $K_2O$, $Na_2O$, $B_2O_3$, $SiO_2$ or $Al_2O_3$ or the combination thereof also can be added to the electrodes 630*a* and 630*b* to adjust the thermal expansion coefficient. The adhesive can be, for example, a glass paste including glass powder, binder resin, and organic solvent, which can be classified into two categories according to existence of lead: lead (Pb)-based glass paste and lead (Pb)-free glass paste.

Regarding lead (Pb)-based glass paste, the glass powder can be a compound including lead (Pb), such as PbO—$B_2O_3$—$SiO_2$, PbO—$B_2O_3$—$SiO_2$—$Al_2O_3$, ZnO—$B_2O_3$—$SiO_2$, PbO—ZnO—$B_2O_3$—$SiO_2$, or the like. The binder resin can be the acrylic resin, such as methyl (meth)acrylate, isopropyl (meth)acrylate, butyl methacrylate, 2-hydroxypropyl methacrylate, or the combination thereof. The organic solvent can be, for example, ketones, alcohols, ether-based alcohols, lactates, ehter-based Ether, Propylene glycol monomethyl ether, Butyl-di-glycol-acetate, or the combination thereof.

In another aspect, regarding to the lead (Pb)-free glass paste, the glass powder can be, for example, $P_2O_5$—SnO—$B_2O_3$, $P_2O_5$—SnO—$Bi_2O_3$, or $Bi_2O_3$—ZnO—$B_2O_3$—$Al_2O_3$—$SiO_2$ ($CeO_2$+CuO+$Fe_2O_3$). The binder resin can be, for example, polyurethane resin, and the organic solvent can be, for example, dimethylformamide, methanol, xylene, butyl acetate, isopropanol, Butyl-di-glycol-acetate, or the combination thereof.

In another embodiment, the electrode 630*a* and 630*b* can be joined with the glass tubes 610, 640*a* and 640*b* by thermal bonding. For example, the joints between the glass tubes 610, 640*a*, 640*b* and the electrodes 630*a*, 630*b* can be heated directly by one to eight flames. Three applicable recipes of manufacture are listed below for illustrative purposes only but not for limitation:

1. one flame, the temperature of the flame is about 1000° C.-1900° C., continuous heating for 5-60 seconds;
2. five flames, the temperature of the flames is about 1000° C.-1900° C., continuous heating for 3-30 seconds; and
3. eight flames, the temperature of the flame is about 1000° C.-1900° C., continuous heating for 3-30 seconds.

It should be noted that temperature and time of heating may vary with the material of the electrodes 630*a*, 630*b* and the glass tubes 610, 640*a*, 640*b*.

Figure 7:
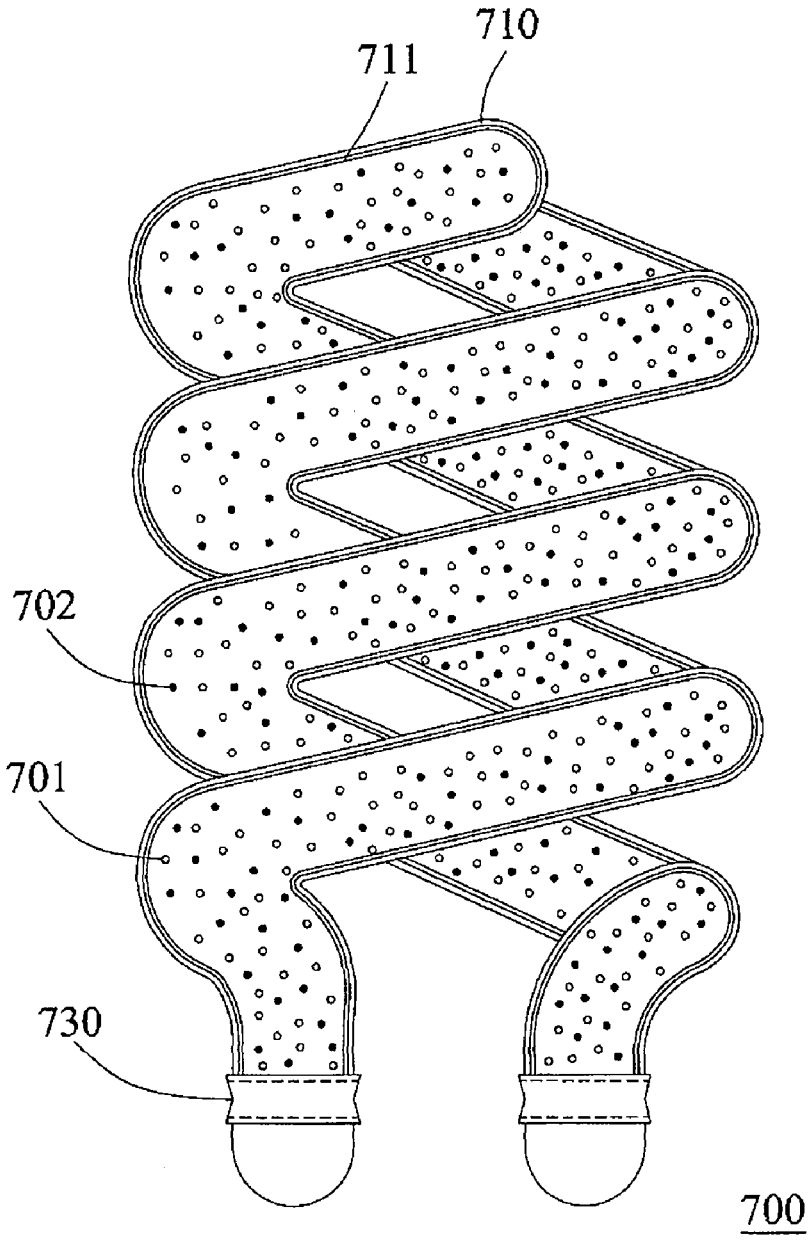
FIG. 7 shows an illustrative diagram of a discharge lamp according to another embodiment of the present invention.

FIG. 7 shows an illustrative diagram of a discharge lamp 700 according to one embodiment of the present invention, which includes a sealed vessel (such as a glass tube) 710, a fluorescent layer 711, green illuminating gas 701, blue illuminating gas 702, and a pair of electrodes 730. Comparing FIG. 7 with FIG. 3, the sealed vessel 710 in FIG. 7 is spiral in shape while the sealed vessel 310 in FIG. 3 is straight in shape, and the electrodes 730 in FIG. 7 are located outside two ends of the sealed vessel 710 while the electrodes 330 in FIG. 3 are located within the sealed vessel 310. One skilled in the art will recognize that the above-mentioned embodiments are intended to be illustrative and not exclusive. The shapes of the sealed vessel and the electrodes may vary with the manufacture process and the subject matter.

Except for the krypton and xenon, the combination of other illuminating gases, which can emit light with different color during the discharge process, can also be applied in the present invention, such as the combination of neon and xenon or the combination of neon and krypton, and correspondingly, the composition of the fluorescent layer would be adjusted. Generally, the preferred wavelength of the colored light emitted from the illuminating gas is about 50 nm to 400 nm. For example, the sealed vessel can be filled with neon and xenon, and the composition of the fluorescent layer can only contain green fluorescent powder without red fluorescent powder and blue fluorescent powder. For another example, the sealed vessel can be filled with neon and krypton, and the composition of the fluorescent layer can only contain blue fluorescent powder without red fluorescent powder and green fluorescent powder.

According to the embodiments of the present invention, the fluorescent layer coated on the inner surface of the vessel includes one or two of the red fluorescent powder, the blue fluorescent powder, and the green fluorescent powder. Further, the illuminating gas filled within the vessel can be any gas which is capable of emitting light with a color different from the color of the fluorescent layer coated on the inner wall of the vessel, such as noble gases or $N_2$. Therefore, the present invention offers an advantage of reducing the amount of usage of the fluorescent powder, which can reduce process cost of the discharge lamp and simplify the steps of manufacturing the fluorescent powder.

While this invention has been described with reference to the illustrative embodiments, these descriptions should not be construed in a limiting sense. Various modifications of the illustrative embodiment, as well as other embodiments of the invention, will be apparent upon reference to these descriptions. It is therefore contemplated that the appended claims will cover any such modifications or embodiments as falling within the true scope of the invention and its legal equivalents.

The invention claimed is:

1. A discharge lamp, comprising:

a sealed vessel having an inner surface;

at least an illuminating gas filled within the sealed vessel; and a fluorescent layer coated on the inner surface;

wherein composition of the fluorescent layer is determined according to a colored light emitted by the illuminating gas during a discharge process within the sealed vessel, such that the colored light is converted into a visible light after passing through the fluorescent layer, wherein the colored light is selected from the group consisting of a combination of red light and green light; a combination of green light and blue light; and a combination of blue light and red light, and wherein when the colored light is a combination of a red light and a green light, the composition of the fluorescent layer comprises blue fluorescent powder without red fluorescent powder and green fluorescent powder;

wherein when the colored light is a combination of a green light and a blue light, the composition of the fluorescent layer comprises red fluorescent powder without green fluorescent powder and blue fluorescent powder; and wherein when the colored light is a combination of a red light and a blue light, the composition of the fluorescent layer comprises green fluorescent powder without red fluorescent powder and blue fluorescent powder.

2. The discharge lamp of claim 1, wherein the illuminating gas is a noble gas.

3. The discharge lamp of claim 2, wherein the noble gas is selected from the group consisting of neon (Ne), krypton (Kr), and xenon (Xe), and wherein the noble gas is neon when the colored light is a red light, the noble gas is krypton when the colored light is a green light, and the noble gas is xenon when the colored light is a blue light.

4. The discharge lamp of claim 2, wherein the colored light is selected from the group consisting of red, green, and blue light, and wherein when the colored light is a red light, the composition of the fluorescent layer comprises green fluorescent powder and blue fluorescent powder without red fluorescent powder;

wherein when the colored light is a green light, the composition of the fluorescent layer comprises red fluorescent powder and blue fluorescent powder without green fluorescent powder; and wherein when the colored light is a blue light, the composition of the fluorescent layer comprises red fluorescent powder and green fluorescent powder without blue fluorescent powder.

5. The discharge lamp of claim 1, wherein the sealed vessel is mercury-free.

6. The discharge lamp of claim 1, wherein the sealed vessel is formed as having a straight shape or a curved shape with at least one curved portion.

7. The discharge lamp of claim 1, further comprising a pair of electrodes located inside the sealed vessel.

8. The discharge lamp of claim 1, further comprising a pair of electrodes located outside two ends of the sealed vessel.

9. The discharge lamp of claim 8, wherein the electrodes are formed as having a shape selected from the group consisting of a circular shape, a cylindrical shape and a cone shape, and material of the electrodes is selected from the group consisting of metal, paraelectric oxide ceramics, ferroelectric oxide ceramics, anti-ferroelectric oxide ceramics, and oxide ceramics with a metal-coated surface.

10. The discharge lamp of claim 8, wherein one of the pair of electrodes is cup-shaped with an opening on one end thereof, and the other of the pair of electrodes is hollow-shaped with openings at two ends thereof.

11. A method of manufacturing a discharge lamp, comprising:

coating a fluorescent layer on an inner surface of a sealed vessel;

filling the sealed vessel with at least one illuminating gas; and adjusting composition of the fluorescent layer according to a colored light emitted by the illuminating gas during a discharge process within the sealed vessel, such that the colored light is converted into a visible light after passing through the fluorescent layer, wherein the colored light is selected from the group consisting of a combination of red light and green light; a combination of green light and blue light; and a combination of blue light and red light, and wherein when the colored light is a combination of a red light and a green light, the composition of the fluorescent layer comprises blue fluorescent powder without red fluorescent powder and green fluorescent powder;

wherein when the colored light is a combination of a green light and a blue light, the composition of the fluorescent layer comprises red fluorescent powder without green fluorescent powder and blue fluorescent powder; and wherein when the colored light is a combination of a red light and a blue light, the composition of the fluorescent layer comprises green fluorescent powder without red fluorescent powder and blue fluorescent powder.

12. The method of claim 11, wherein the illuminating gas is a noble gas.

13. The method of claim 12, wherein the noble gas is selected from the group consisting of neon (Ne), krypton (Kr), and xenon (Xe), and wherein the noble gas is neon when the colored light is a red light, the noble gas is krypton when the colored light is a green light, and the noble gas is xenon when the colored light is a blue light.

14. The method of claim 12, wherein the colored light is selected from the group consisting of red, green, and blue light, and wherein when the colored light is a red light, the composition of the fluorescent layer comprises green fluorescent powder and blue fluorescent powder without red fluorescent powder;

wherein when the colored light is a green light, the composition of the fluorescent layer comprises red fluorescent powder and blue fluorescent powder without green fluorescent powder; and wherein when the colored light is a blue light, the composition of the fluorescent layer comprises red fluorescent powder and green fluorescent powder without blue fluorescent powder.

15. The method of claim 11, wherein the sealed vessel is mercury-free.

16. The method of claim 11, wherein the sealed vessel is formed as having a straight shape or a curved shape with at least one curved portion.

17. The method of claim 11, further comprising a pair of electrodes located inside the sealed vessel.

18. The method of claim 11, further comprising a pair of electrodes located outside two ends of the sealed vessel.

19. The method of claim 18, wherein the electrodes are formed as having a shape selected from the group consisting of a circular shape, a cylindrical shape and a cone shape, and material of the electrodes is selected from the group consisting of metal, paraelectric oxide ceramics, ferroelectric oxide ceramics, anti-ferroelectric oxide ceramics, and oxide ceramics with a metal-coated surface.

20. The method of claim 18, further comprising the following step:

joining the electrodes and the sealed vessel by thermal bonding.

21. The method of claim 18, further comprising the following step:

joining the electrodes and the sealed vessel by using an adhesive, wherein the adhesive comprises glass powder, binder resin, and organic solvent.

22. The method of claim 18, wherein one of the pair of electrodes is cup-shaped with an opening on one end thereof, and the other of the pair of electrodes is hollow-shaped with openings at two ends thereof.

23. The method of claim 22, further comprising the following step:

joining the cup-shaped electrode and the sealed vessel by sealing; and joining the hollow-shaped electrode and the sealed vessel by thermal bonding or by using an adhesive.

* * * * *